US005424496A

United States Patent [19]

Kreitmeier

[11] Patent Number: 5,424,496

[45] Date of Patent: Jun. 13, 1995

[54] ELECTROMAGNETIC CONVERTER

[75] Inventor: Leonhard Kreitmeier, Bogen, Germany

[73] Assignee: Nokia (Deutschland) GmbH, Pforzheim, Germany

[21] Appl. No.: 159,771

[22] Filed: Nov. 30, 1993

Related U.S. Application Data

[63] Continuation of Ser. No. 942,298, Sep. 9, 1992, abandoned.

[30] Foreign Application Priority Data

Sep. 13, 1991 [DE] Germany ..... 41 30 460.8

[51] Int. Cl.[6] ..... G10K 13/00; H04R 25/00

[52] U.S. Cl. ..... 181/161; 181/173; 381/199; 381/204

[58] Field of Search ..... 181/161, 162, 164, 165, 181/171, 172, 173; 381/188, 194, 199, 201, 204, 205

[56] References Cited

U.S. PATENT DOCUMENTS

| | | | |
|---|---|---|---|
| 4,868,882 | 9/1989 | Ziegenberg et al. | 381/200 |
| 5,022,084 | 6/1991 | Shinjo | 181/161 |
| 5,214,710 | 5/1993 | Ziegenberg et al. | 381/199 |

FOREIGN PATENT DOCUMENTS

| | | |
|---|---|---|
| 3730305 | 9/1987 | Germany . |
| 4021651 | 6/1991 | Germany . |
| 523540 | 8/1972 | U.S.S.R. . |
| 9004317 | 4/1990 | WIPO . |

*Primary Examiner*—Khanh Dang
*Attorney, Agent, or Firm*—Ware, Fressola, Van Der Sluys & Adolphson

[57] ABSTRACT

To improve loudspeakers (10) with an internal magnet system (11), it is proposed that the moving coil (21) be carrierless in configuration, and be attached to a tubular segment (20) configured concurrently when the membrane (13) is produced.

2 Claims, 1 Drawing Sheet

ELECTROMAGNETIC CONVERTER

This a continuation of application(s) Ser. No. 07/942,298 filed on Sep. 9, 1992, abandoned.

TECHNICAL FIELD

The invention relates to electromagnetic converters for reproducing sounds whose magnet systems have an internal leakage field magnet.

BACKGROUND OF THE INVENTION

Converters of this type have been known for some time in the prior art. Reference is made to DE-P 37 30:305 as a representative thereof. This document discloses an. electromagnetic converter which, in contrast to conventional dynamic converters, has a magnet coil which is surrounded concentrically at a short distance by the moving coil. The magnet system consists of two permanent magnet disks between which the field disk–also called the leakage disk–is arranged. One permanent magnet disk of the magnet system is attached to the baseplate of the loudspeaker housing, while the other permanent magnet disk extends in the direction of the membrane. The magnet system is surrounded by the moving coil concentrically and at a distance. The arrangement of the moving coil in the region of the field disk is standard. The moving coil is arranged on a "moving coil carrier" that is attached at one end, facing away from the baseplate of the loudspeaker frame, to the end of the conical membrane that has the smaller of the two diameters. The joint between membrane and moving coil carrier is implemented in the customary way as an adhesive joint.

The adhesive joint just described makes the production process more costly and also increases the weight of the vibrating parts.

DISCLOSURE OF INVENTION

An object of the present-invention is to make the converter production process less costly.

Another object is to decrease the weight of the vibrating parts of a converter.

These objects are achieved by the fact that the end of the conical membrane that has the smaller of the two diameters may be configured or manufactured as a tubular segment and may be integral to the conical membrane, and that the moving coil is attached to the tubular segment. In other words, the conical membrane and the tubular segment may be formed as a single unit. The configuration of the membrane and tubular segment as one piece ensures that the seam region between moving coil carrier and membrane, which otherwise would require a complex joint because of the forces that need to be transferred, is omitted. In addition to the resulting savings in the weight of the vibrating parts, this has the additional advantage that the use of identical materials for the membrane and tubular segment/moving coil carrier improves the recyclability of such a loudspeaker.

It is very particularly advantageous if, according further to the invention, the tubular segment extends in the direction of the baseplate of the loudspeaker frame. The reason is that the centering membrane can then be applied onto the outer periphery of the tubular element with no need to extend the tubular element and thus increase the overall installation depth of the loudspeaker in order to do so. This extension is especially necessary when the tubular segment extends into the membrane cone. Specifically, in this case an additional tubular segment extending in the direction of the baseplate of the loudspeaker frame,– which with the system in the rest position projects below the field disks and serves as mounting flange for the centering membrane, is necessary. Since the length of the aforesaid tubular segment shortens the stroke length of the moving coil in the direction of the baseplate of the loudspeaker frame, it is necessary, in order to ensure that the stroke length for the moving coil is not modified by the new tubular segment, to place the baseplate of the loudspeaker frame farther away from the magnet system. In many applications, however, the increased loudspeaker depth associated with this feature is undesirable.

If, in further accord with the present invention, the end of the tubular segment that faces away from the membrane is configured with an internal flange which reduces the inside diameter of the tubular segment and extends at right angles to the outside surface of the tubular segment, this has the advantage that the moving coil can be fitted to this loudspeaker with particular ease. Specifically, all that is needed to do so is to place the wound, carrierless moving coil on the flange from the membrane opening side, and adhesively bond it. With this configuration of the tubular segment, it is no longer necessary to immobilize the moving coil until the adhesive has cured. No particular outlay for the flange is required if the membrane and tubular segment are configured in a single piece and the flange is configured simultaneously therewith. These and other objects, features and advantages of the present invention will become more apparent in light of the detailed description of an embodiment thereof, as illustrated in the accompanying drawing.

BEST MODE FOR CARRYING OUT THE INVENTION

Figure 1:
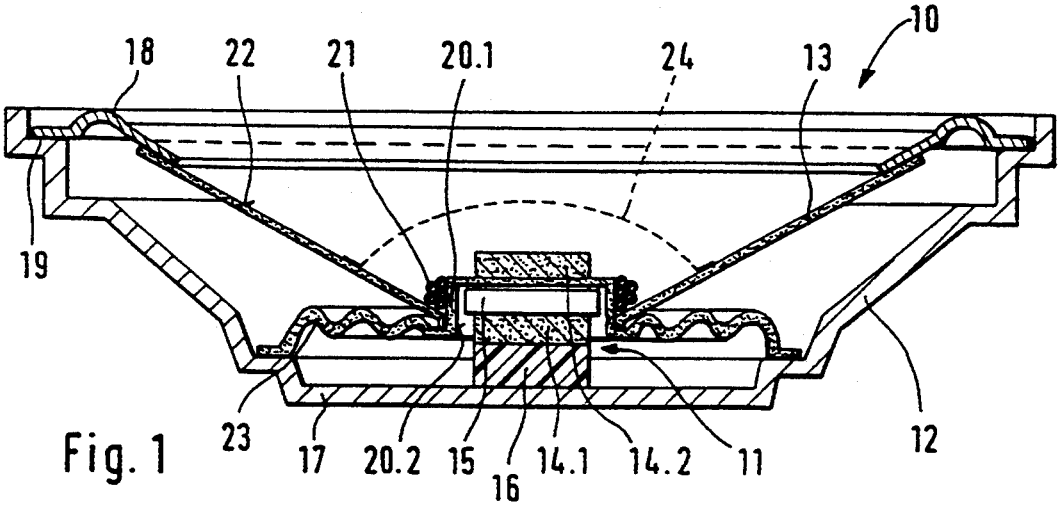
FIG. 1 shows a loudspeaker with internal magnet system, in section.

The loudspeaker 10 shown in FIG. 1 consists essentially of a magnet system 11, a loudspeaker frame 12, and a membrane 13. The magnet system 11 consists of two permanent magnet disks 14.1 and 14.2 , between which is arranged a field disk 15. The lower permanent magnet disk 14.1 rests on a pedestal 16 which is centered on the baseplate 17 of the loudspeaker frame 12.

The membrane 13 is conical in shape. The end of the membrane 13 which has the larger of the two diameters is attached by means of the convex surround 18 to the upper rim 19 of the loudspeaker frame 12. The other end of the membrane 13 has a longer tubular segment 20.1 which projects into the cone formed by the outside surface of the membrane 13. The shorter portion of the tubular segment 20.2 extends towards the baseplate 17 of the loudspeaker frame 12. The membrane 13 and the tubular segments 20.1 and 20.2 are configured as a unitary non-metallic piece. These tubular segments 20.1 and 20.2 surround tile magnet system 12 concentrically at a defined distance.

The moving coil is placed around the upper tubular segment 20.1 and attached. This arrangement is especially advantageous because it eliminates the need to immobilize the carrierless moving coil while it is being adhesively bonded to the tubular segment 20.1. Instead, the moving coil 21 contacts the inner peripheral surface 22 of the membrane 13.

The outer peripheral surface of the lower tubular segment 20.2 is adhesively bonded to the centering membrane 23. The other rim of the centering membrane 23 is mounted on the loudspeaker frame 12.

As the dashed line indicates, the magnet system 11 is covered by a dust protection cap 24 arranged on the inner contour of the membrane 13.

It should also be mentioned that for the sake of clarity, the connections for the moving coil 21 have been omitted from the depiction.

Figure 2:
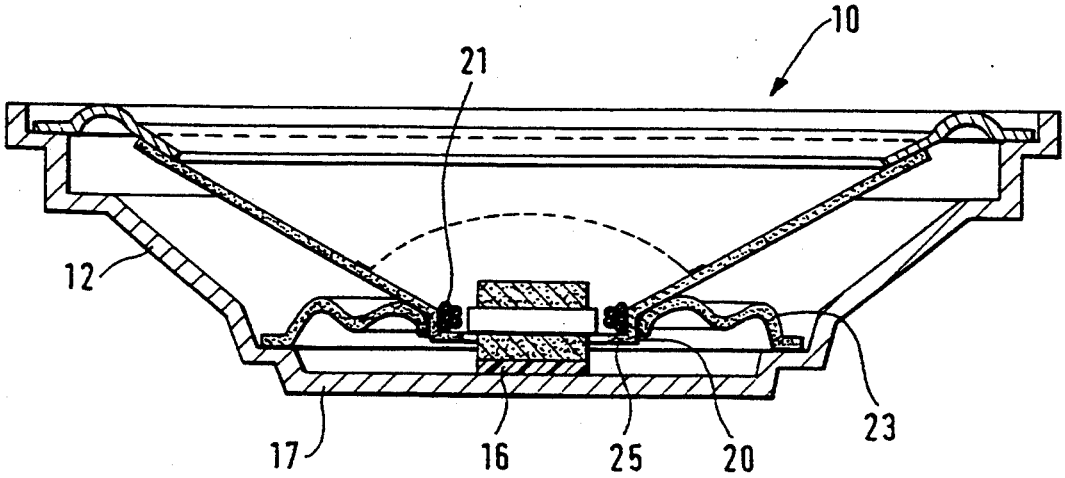
FIG. 2 shows a further loudspeaker with internal magnet system, in section.

The loudspeaker 10 shown in FIG. 2 differs very little from the loudspeaker shown in FIG. 1, so that the reference numbers used in FIG. 1 can also, for the most part, be transferred to FIG. 2.

The most conspicuous difference between the loudspeaker 10 shown in FIG. 2 and the loudspeaker shown in FIG. 1 is that in FIG. 2, the tubular segment 20 extends only in one direction, namely towards the baseplate 17 of the loudspeaker frame 12. In addition, the total depth of the loudspeaker 10 also turns out to be less as a result, since the tubular segment 20.2 required in FIG. 1 to mount the centering membrane 23 is omitted, or is replaced in FIG. 2 by the outer peripheral surface of the tubular segment 20.

This reduction in the total installation depth of the loudspeaker 10 is demonstrated in FIG. 2 especially by the fact that the pedestal 16 which rests on the baseplate 17 of the loudspeaker frame 12 has a height that is considerably reduced compared to the pedestal 16 in FIG. 1. Furthermore, the end of the tubular segment 20 facing the baseplate 17 of the loudspeaker frame has a flange 25 which is bent at right angles to the peripheral surface of the tubular segment 20. This flange 25 serves as support for the carrierless moving coil 21, which is inserted along the inner contour of the tubular segment 20, during the period when the adhesive used to bond the moving coil 21 and tubular segment 20 is curing.

Once again, the connections to the moving coil 21 were not depicted in FIG. 2 for the sake of clarity.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

I claim:

1. An electromagnetic converter for reproducing sounds, comprising a. a unitary non-metallic conical membrane and a tubular element, the tubular element extending from the smaller end of the conical membrane;

b. a moving coil disposed against the inside of the tubular element;

c. frame means supporting the membrane by its larger end; and d. a magnet system supported by the frame means and comprising two permanent magnet disks, between which a field disk is disposed, the system disposed concentrically within the tubular element, the moving coil being in a region of the field disk at a distance therefrom wherein the unitary conical membrane and tubular element has a unitary inwardly extending annular flange extending perpendicularly from the end of the tubular element opposite the conical membrane for supporting the moving coil.

2. Electromagnetic converter according to claim 1, wherein the tubular segment extends out of the smaller diameter end towards a baseplate of a frame within which the conical membrane, moving coil and magnet system are mounted.

* * * * *